United States Patent [19]

Nakashima et al.

[11] 4,388,112

[45] Jun. 14, 1983

[54] STEELMAKING PROCESS WITH SEPARATE REFINING STEPS

[75] Inventors: Hiroyuki Nakashima, Kisarazu; Morihiro Sumida; Hiroki Goto, both of Kimitsu, all of Japan

[73] Assignee: Nippon Steel Corporation, Japan

[21] Appl. No.: 243,451

[22] Filed: Mar. 13, 1981

[30] Foreign Application Priority Data

Mar. 21, 1980 [JP] Japan ..... 55-34693
Jan. 23, 1981 [JP] Japan ..... 56-8855

[51] Int. Cl.[3] ..... C21C 7/00; C21C 7/02
[52] U.S. Cl. ..... 75/51; 75/58; 75/60
[58] Field of Search ..... 75/51–58, 75/59, 60

[56] References Cited

U.S. PATENT DOCUMENTS 3,843,354 10/1974 Nilles ..... 75/52
3,881,917 5/1975 Murton ..... 75/52

*Primary Examiner*—P. D. Rosenberg
*Attorney, Agent, or Firm*—Wenderoth, Lind & Ponack

[57] ABSTRACT

The present invention relates to a steelmaking process, in which the molten pig iron produced in a blast furnace is desiliconized, dephosphorized, decarburized and desulfurized. The characteristic of this invention is a sequence and combination of the refining steps. Namely, the steelmaking process of this invention has individual separate refining steps for realizing a removal reaction of the impurities. The objective reaction is the desiliconization in the first step, the dephosphorization in the second step, the decarburization in the third step and the desulfurization in the fourth step.

31 Claims, 3 Drawing Figures

STEELMAKING PROCESS WITH SEPARATE REFINING STEPS

BACKGROUND OF THE INVENTION

1. Field of the Invention

The present invention relates to a steelmaking process and, more particularly, a steelmaking process comprising a series of refining steps for converting the molten pig iron obtained from a blast furnace into molten steel.

2. Description of the Prior Art

Recently, in accordance with the development of ultra low sulfur steels and ultra low phosphorus steels, stricter demands are imposed upon the dephosphorization and desulfurization of the steelmaking process. In the conventional steelmaking process, most of the impurities such as silicon, phosphorus, sulfur and carbon are removed in the blowing step using a converter, with the result that the load, which the converter must bear in the steelmaking operation, becomes high. According to a known process which aims to mitigate the converter load and to simplify the control of each component of the molten iron, several impurities are removed at the pig iron stage, while in the converter mainly decarburization is carried out. An example of the known process mentioned above is that disclosed in Japanese Laid Open Patent Application No. 127421/1977, wherein the desiliconization is carried out by an iron oxide or oxygen, followed by a simultaneous dephosphorization and desulfurization by means of $Na_2CO_3$. The removal of all the silicon, phosphorus and sulfur in the pig iron stage is desirable from the view point of mitigating the converter load. However, from the view point of the desulfurization and dephosphorization reactions, the desulfurization treatment is desirably realized under a reducing atmosphere i.e. with a slag having low FeO content, while the dephosphorization treatment is desirably realized under an oxidizing atmosphere, i.e. with a slag having high FeO content. Efficient desulfurization and dephosphorization conditions are, therefore, contradictory to one another. Accordingly, simultaneous desulfurization and dephosphorization are not efficient and thus involve problems when applied in practical operation.

The two kinds of refining agents mentioned hereinafter are mainly used at present for the simultaneous desulfurization and dephosphorization. Namely, one of the refining agents is based on $Na_2CO_3$, while the other is based on CaO and an oxidizer, such as a mill scale, iron ore, oxygen gas and the like. As illustrated in Japanese Laid Open Patent Application No. 127421/1977, $Na_2CO_3$ is an efficient flux for the simultaneous desulfurization and dephosphorization of a low silicon-molten pig iron, because $Na_2CO_3$ has within itself "O", which is an oxidizer, and "$Na_2O$" which is a base. In the dephosphorization reaction, the reaction between O, $Na_2O$ and P formulated as:

$$50(\text{from } Na_2CO_3)+2P+3Na_2O \rightarrow 3Na_2O.P_2O_5,$$

proceeds, while in the desulfurization reaction, the reaction between $Na_2O$ and S formulated as:

$$Na_2O+S \rightarrow Na_2S+O,$$

proceeds. The processing unit of $Na_2CO_3$ described in the Japanese Laid Open Patent Application is in the range of from 10 to 60 kg/t. The use of $Na_2CO_3$ as the refining agent or flux involves problems from the view points of excessive cost and erosion of the refractory of the processing vessel due to vigorous reactivity of $Na_2CO_3$ as well as environmental pollution due to formation of smoke and fumes. The flux based on $Na_2CO_3$ is, therefore, not suitable for practical application for the desulfurization and dephosphorization.

Also, with regard to the simultaneous desulfurization and dephosphorization by means of the refining agent based on the oxidizer and CaO, effective desulfurization and dephosphorization conditions are contradictory to one another as explained hereinabove, and, an excess CaO is necessary to carry out the desulfurization under an oxidizing atmosphere or under the presence of the oxidizer. The simultaneous desulfurization and dephosphorization are therefore of low efficiency, and, therefore the desulfurization and dephosphorization processes should be carried out in two separate stages.

Incidentally, silicon, phosphorus and sulfur are desirably removed at the molten pig iron stage, and various proposals have been made with regard to the removal of silicon and the like. However, if three stages for desiliconization, dephosphorization and desulfurization, respectively, are employed in the processing of the pig iron, not only does the steelmaking process become complicated but also the temperature drop of molten pig iron during the processing is so conspicuous, that the industrialization of this process with the three stages becomes difficult.

Since the removal and shape-control of the non-metallic inclusions have recently been required to meet the stricter demands for producing clean steels, development of a secondary refining process after the steel tapping, such as an inert-gas blowing and degassing, is promoted. The desulfurization, desiliconization and dephosphorization described hereinabove are carried out separately or a plurality of them occur continuously or simultaneously in the previous various proposals. However, a process for treating all impurities of molten iron, wherein the individual divided steps are combined systematically so as to provide an efficient refining technique, has not yet been proposed.

SUMMARY OF THE INVENTION

A steelmaking technique, wherein the desiliconization and dephosphorization take place in the molten pig iron stage, and wherein in the molten steel stage not only the removal of non-metallic inclusions but also the refining occur simultaneously, is believed to be more efficient than the prior art techniques. More specifically, when an inert gas is blown into molten steel contained in a vessel so as to remove the non metallic inclusions, a refining agent, such as CaO, can be carried by the inert gas and thus blown into the molten steel, with the consequence that the desulfurization at the molten pig iron stage can be entirely replaced with the desulfurization at the molten steel stage. This results in elimination of such problems as the complicated processing, temperature drop of the molten pig iron and of the disadvantages resulting from the simultaneous desulfurization and dephosphorization. When decarburization is followed by desulfurization, a high temperature reaction in the decarburized iron, which is thermodynamically advantageous for the desulfurization, is utilized. Besides it is possible to solve the problem, that is, the steel scraps to be charged in a converter must be carefully selected to have a low sulfur grade thereby preventing the occurence of resulfurization in the converter.

It is the primary object of the present invention to provide a practically efficient steelmaking process, wherein removal techniques of the impurities are combined systematically in an optimum sequence and under optimum refining conditions.

A steelmaking process by the separate refining stages comprises the sequence of the following steps of:

the first step of incorporating an oxidizer into a molten pig iron produced by a blast furnace, thereby causing the desiliconization reaction to occur and thus reducing the silicon content of the pig iron to a value not more than approximately 0.2%, and separating the resultant slag from the treated molten pig iron;

the second step of incorporating the first refining agent mainly composed of an oxidizer and a calcium oxide bearing material into the molten pig iron contained in a first vessel, thereby causing the dephosphorization reaction to occur and thus reducing the phosphorus content of the pig iron to a value not more than approximately 0.040%, and separating the resultant slag from the treated molten pig iron;

the third step of blowing an oxygen gas into a second vessel, thereby causing the decarburization to occur and thus reducing the carbon content of the iron to a desired value; and, the fourth step of incorporating the second refining agent mainly composed of CaO into the molten steel contained in a third vessel, thereby causing the desulfurization reaction to occur.

In the process of the present invention, the removal of the impurities other than the objective impurity to be removed in each step takes place incidentally, however, such removal is undesirable from the point of view of thermodynamics as explained above in BACKGROUND OF THE INVENTION. In addition, the objective impurity must be reduced to or less than the value specified in the first, second and third steps, respectively. That is, it is not necessary to control the impurities other than the objective impurity in each of these three steps so as to reduce their content to specified values. Desirably, the contents of carbon, silicon and phosphorus are reduced to be lower than or to fall within the standard value or range, before the commencement of the fourth step. In the fourth step, desulfurization is carried out, preferably in conjunction with the removal of the non-metallic inclusions. Since the refining in the fourth step is brought about under a reducing atmosphere, the removal of the impurities other than sulfur is of a negligible extent.

In accordance with the present invention, there is also provided a process, wherein only the molten pig iron dephosphorized in the second step is withdrawn from the first vessel, and further the first vessel reserving the resultant dephosphorizing slag is used for effecting the first step for desiliconization of a new molten pig iron from a blast furnace. According to this process, the resultant dephosphorizing slag generated in the second step for the dephosphorization pretreatment of a molten pig iron is not withdrawn but is circulated in the pretreatment process of the pig iron. This leads to the elimination of both the devices used for withdrawing the dephosphorizing slag and the processing step of the slag. In addition, the loss of pig iron remaining in the dephosphorizing slag can be prevented, since the slag is not withdrawn after every dephosphorization operation.

DESCRIPTION OF THE PREFERRED EMBODIMENTS

First Step

Figure 1:
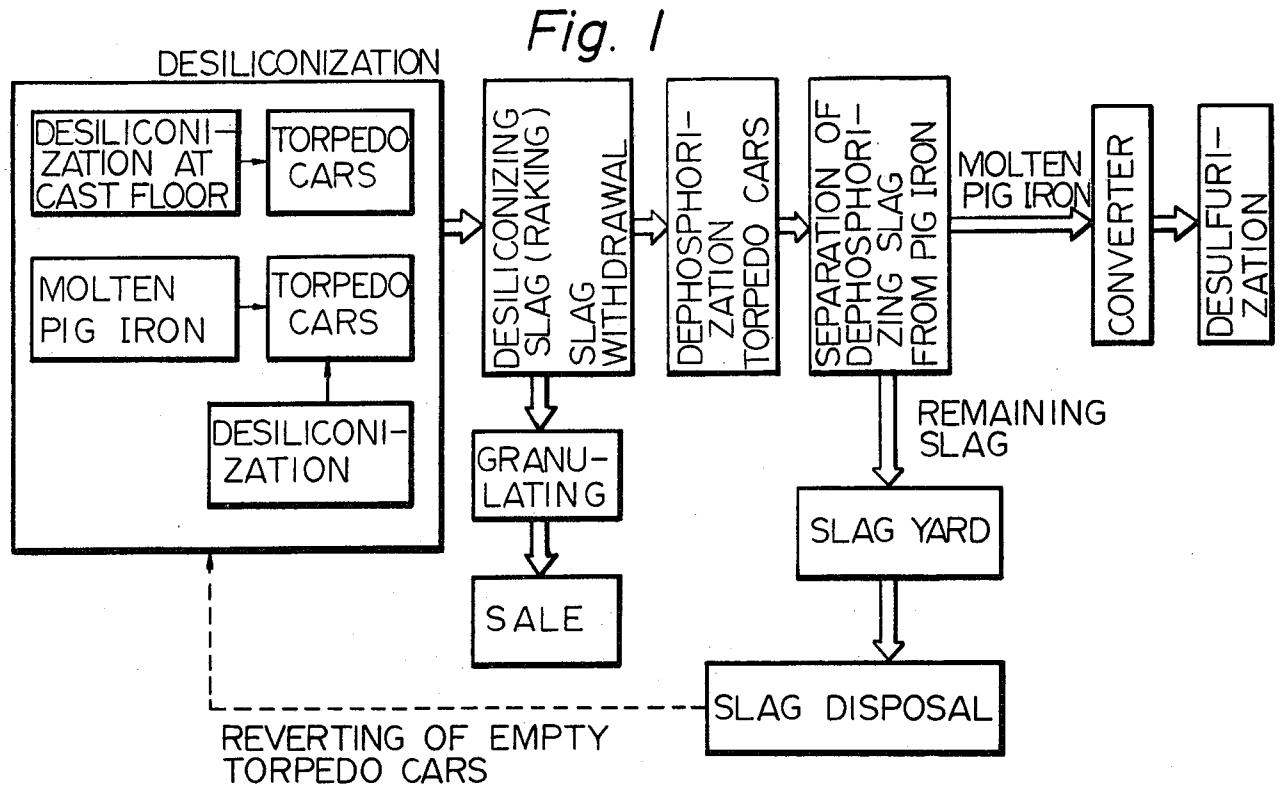
FIG. 1 is a flow chart illustrating the processing steps of the molten iron according to an embodiment of the present invention.

The primary purpose of the first step according to this invention is desiliconization. This invention employs molten pig iron produced in a blast furnace. The composition of the molten pig iron varies depending upon the raw materials charged in the furnace and the operating conditions of the furnace, and it generally contains from 4.3 to 4.7% C, from 0.3 to 0.8% Si, from 0.4 to 0.9% Mn, from 0.080 to 0.200% P and from 0.015 to 0.0050% S. In the first step, silicon of the molten pig iron is removed by means of flowing a small amount of oxygen or preferably incorporating an iron oxide, such as a mill scale, into the molten pig iron. It is also possible to convey the iron oxide into the molten pig iron by means of the oxygen gas. By the removal of silicon the silicon content is reduced to a value not more than approximately 0.2%. An oxidizer comprising an iron oxide and/or oxygen may be incorporated into the molten pig iron at the stage where the molten pig iron tapped from a blast furnace flows along the pig runner on the cast floor. The oxidizer is stirred with the molten pig iron flowing along the pig runner due to the flow of the pig iron in the pig runner or due to a forced stirring. Alternatively, the oxidizer may be added into or stirred with the molten pig iron contained in a mixer car which has received the molten pig iron flowing from the pig runner of a blast furnace. In addition, the oxidizer may be blown into the molten pig iron by means of the carrier gas which includes inert gas and oxygen. The vessel, in which the first step is carried out may be an iron ladle instead of the mixer car. The silicon content is reduced generally from the level of approximately 0.50% to the level of approximately 0.15%. In order to reduce the silicon content to a level of less than approximately 0.10%, the amount of iron oxide must be increased and the operation efficiency is thus reduced. It is, therefore, desirable to perform the desiliconization, so that the molten pig iron with a silicon content ranging from approximately 0.10 to approximately 0.20% is obtained. The amount of iron oxide for achieving this range of silicon content is determined based on the presumption that the most of the iron oxide is caused to react with silicon, and a small part causes the decarburization and oxidation of manganese. A slag-forming material, such as CaO, may be incorporated into the molten pig iron in addition to the oxidizer. The resultant slag of the first step is not transferred to the second step but is separated from the treated molten pig iron.

Second Step

The primary purpose of the second step is the dephosphorization of the molten pig iron which has undergone the first step. The molten pig iron is transferred from the installation, where the desiliconization is carried out, to the first vessel, i.e. a mixer car, an iron ladle and the like, and the dephosphorization operation is carried out by the first refining agent. The first refining agent is mainly composed of an oxidizer, such as an iron oxide in the form of for example, mill scale, and a calcium oxide-bearing material selected at least from one of the group consisting of CaO and $CaCO_3$. The first refining agent may be a powdered mixture of the mill scale, CaO and $CaF_2$ taken in a weight proportion of 3 8:2 6:1, for example 4:2:1 and preferably 6:4:1. The grain of this powder mixture may be dressed, so that the grain size does not exceed 1 mm. The first refining agent prepared by the powder mixture mentioned above is blown into the molten pig iron together with a carrier gas, such as an inert gas, at an amount ranging from 30 to 50 kg per ton of the pig iron, thereby reducing the phosphorus content to a level of approximately 0.040% or lower. The first refining agent may be in the form other than the powder. The first refining agent does not contain $Na_2CO_3$, which is expensive, and does not exhibit a violet reactivity, with the consequence that a predetermined dephosphorization amount can be economically realized without causing a considerable erosion of the first vessel. It is preferable from the viewpoint of operation efficiency that the phosphorus content after the dephosphorization is not less than 0.015%.

Third Step

The primary purpose of the third step is decarburization. The molten pig iron obtained in the precedent steps and having the silicon content of not more than approximately 0.2% and the phosphorus content of not more than approximately 0.040% is charged in the second vessel which may be a converter or another vessel adapted to carry out the decarburization. The identical vessel can be used for both the second and third steps provided that the resultant dephosphorizing slag is separated from the molten pig iron to be decarburized. The molten pig iron is charged for example into a converter together with the iron scraps and is decarburization-blown to reduce its carbon content to a desired level which may or may not fall within the standard range of the final steel product. In the third step, the composition and amount of the slag is not determined considering the dephosphorization and desulfurization but is determined enough for only the protection of the constructing material of the second vessel. For the protection of the material of which the converters are constructed, from 1 to 10 kg of quick lime and from 1 to 10 kg of a lightly baked dolomite are added as auxiliary raw materials into the converter per ton of the pig iron. When the phosphorus content reduced in the second step is not sufficiently low when compared to the final steel product, the amounts of the quick lime and dolomite can be slightly increased or decreased from those judged to be sufficient for the protection of the constructing materials of the third vessel.

Fourth Step

The primary object of the fourth step is the desulfurization of the desiliconized, dephosphorized and decarburized molten steel. Desirably, prior to starting the fourth step, the silicon, phosphorus and carbon contents of the molten steel fall within the respective standard ranges of the final steel product. In the fourth step, the desulfurization is carried out in the third vessel, for example a ladle, by means of the second refining agent which is mainly composed of CaO powder and which may contain a small amount of $CaF_2$. The second refining agent and its carrier gas, for example argon gas, may be blown into the molten steel contained in a ladle, so that the second refining agent is incorporated into the molten steel at an amount ranging from 0.5 to 6 kg, preferably approximately 2 kg, per ton of molten steel. As a result of this blowing, the sulfur content is reduced to a level less than the standard value of the final steel product. The sulfur content can be reduced from the level of approximately 0.030% to the level of approximately 0.010% in the fourth step. The sulfur content adjustment in the fourth step, which results in obtaining the steel having the desired final composition, is advantageous, in that the desulfurization reaction is more liable to proceed due to a higher temperature of the molten iron than in the first and second steps; and, the refining conditions of the fourth step are adjusted considering only the desulfurization reaction of the refining reactions. On the other hand, in the conventional processes, when an attempt is made to produce an ultra low sulfur steel of up to 0.010% of S, a unit of the refining agents used for reducing the impurity content becomes disadvantageously high, or, if this unit is kept low, the content of the impurities other than sulfur cannot be reduced to a desired level. However, in accordance with the present invention, the combination of the efficient processing steps makes it possible to achieve effects which are considerably reasonable and advantageous in the steelmaking operation.

FIG. 1 illustrates an embodiment of the steelmaking process according to the present invention. The molten pig iron is subjected to the desiliconization using, for example, an iron oxide, at the cast floor of a blast furnace or in mixer cars which may be occasionally referred to as torpedo cars in the steel industry. The resultant slag is separated from the desiliconized molten pig iron by raking the slag from the torpedo cars. The dephosphorization is carried out in torpedo cars. These are the same torpedo cars as used for the desiliconization, in the case where the desiliconization is not carried out on the cast floor. After the dephosphorization, the resultant dephosphorizing slag is separated from the molten pig iron, by transferring the dephosphorized molten pig iron into an iron ladle and leaving the resultant dephosphorizing slag in the torpedo cars with the aid of a slag stopper. The dephosphorizing slag remaining in the torpedo cars is completely withdrawn from the torpedo cars at a predetermined slag yard and then subjected to a slag disposal. The empty torpedo cars are then reverted to the desiliconization step so as to use it for the desiliconization of molten pig iron from a blast furnace. In this embodiment illustrated in FIG. 1, a permanently established disposal location for the discarded slag and a time for emptying the torpedo cars amounting to 5 minutes or longer are necessary. In addition, the pig iron contained in the discarded slag is disadvantageously lost. The disadvantages of the embodiment mentioned above can be completely eliminated by another embodiment of the present invention, wherein the dephosphorized molten pig iron is withdrawn from and the dephosphorizing slag and remains within the first vessel, and further this first vessel, in which the dephosphorizing slag remains, is used for receiving and desiliconizing a new molten pig iron from the blast furnace.

Figure 2:
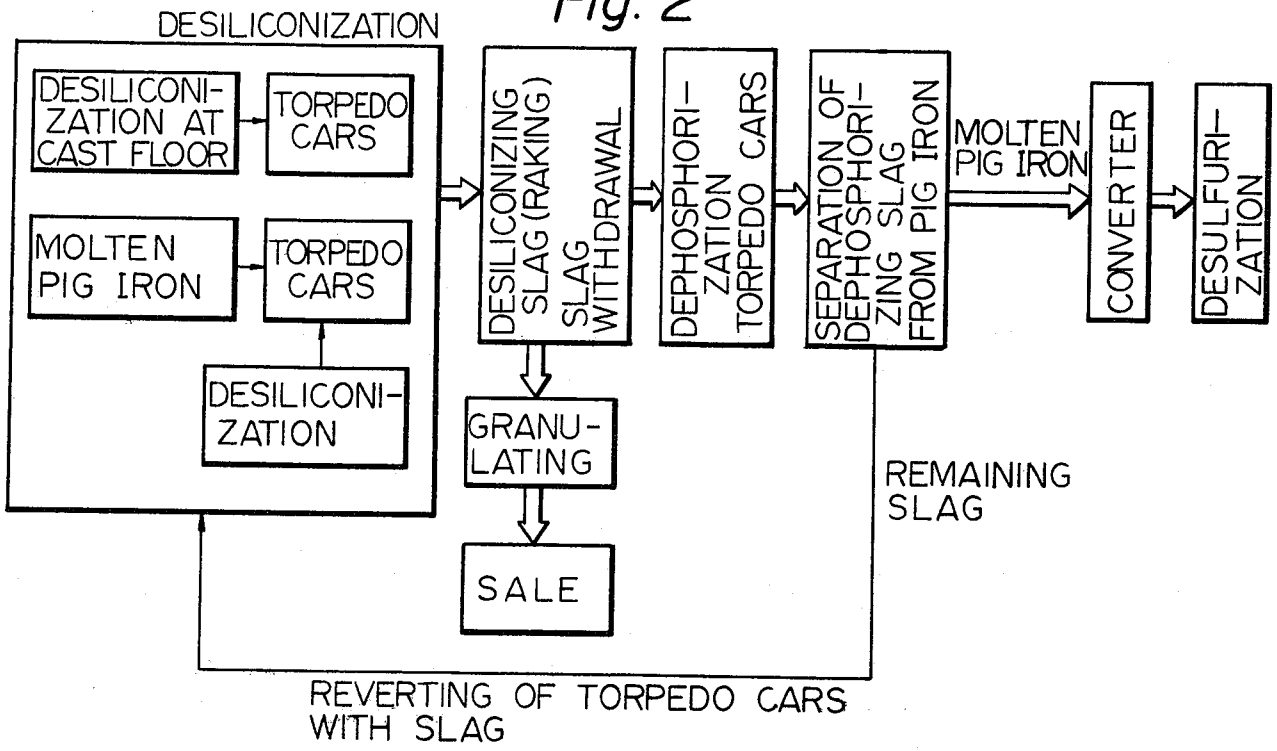
FIG. 2 is a flow chart similar to FIG. 1 and illustrating another embodiment of the present invention.

Referring to FIG. 2, in which an embodiment of the present invention is illustrated by a flow chart, molten pig iron from a blast furnace is preliminarily desiliconized by incorporating a desiliconization agent, for example an iron oxide in the form of mill scale, thereinto, for example on the cast floor, and the desiliconized molten pig iron is supplied into torpedo cars. Alternatively, the molten pig iron from the blast furnace is supplied into the torpedo cars and is preliminarily desiliconized in the torpedo cars by incorporating the desiliconization agent into the torpedo cars. Subsequently, the resultant desiliconizing slag is separated from the molten pig iron, and this molten pig iron is then subjected to dephosphorization by incorporating thereinto the first refining agent which comprises a refining agent in the form of a flux mixture of mill scale, CaO and $CaF_2$. The dephosphorized molten pig iron is poured from the torpedo cars into an iron ladle or ladles, while the resultant dephosphorizing slag remains in the torpedo cars. The iron ladle or ladles prepared for receiving the dephosphorized molten pig iron is transferred to the steelmaking step by a converter, namely only the molten pig iron of the melt, which has been contained in the torpedo cars, is transferred to such steelmaking step by the converter. The steelmaking steps described above and illustrated in FIG. 2 are the same as those illustrated in FIG. 1. However, the dephosphorizing slag remaining in the torpedo cars is not discarded. The dephosphorizing slag, which maintains its high temperature, is reverted to the desiliconization step of new molten pig iron from the blast furnace. In the desiliconization step, the desiliconizing slag and the molten pig iron, which is tapped from the blast furnace and is then desiliconized on the cast floor, are supplied together into the torpedo cars which contain the dephosphorizing slag. Alternatively, the molten pig iron may be supplied from the blast furnace into the torpedo cars and then the desiliconization is carried out by incorporating a desiliconizing agent into the molten pig iron contained in the torpedo cars. In the desiliconization step, a slag mixture of the desiliconizing and dephosphorizing slags is formed. After the silicon of the molten pig iron is decreased to a desired level, the desiliconizing- and dephosphorizing- slag mixture is raked from the torpedo cars, so that the molten pig iron remains in the torpedo cars. The first refining agent comprising a dephosphorizer is then incorporated into the molten pig iron to dephosphorize this iron. Subsequently, only the dephosphorized molten pig iron is transferred from the torpedo cars to a vessel or vessels separated from the torpedo cars. This vessel or vessels are transferred to the steelmaking step which employs a converter. The torpedo cars, in which either the dephosphorization or the desiliconization followed by dephosphorization is carried out, still contain the dephosphorizing slag, when this slag is separated from the molten pig iron, and these torpedo cars are transferred to the desiliconization step, without withdrawing the dephosphorizing slag from the torpedo cars. As a result of such transfer, it is possible to eliminate the discarding operation of the dephosphorizing slag, which has a low flowability, and also to prevent the loss of pig iron in the slag.

Figure 3:
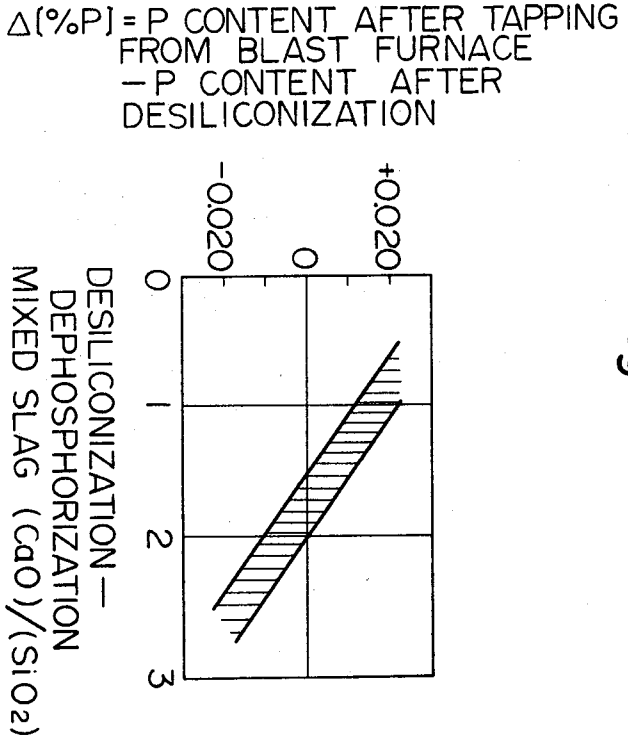
FIG. 3 is a graph illustrating a relationship of the rephosphorization amount at the desiliconization step versus the basicity of a mixture slag of the dephosphorization and desiliconization slags.

Incidentally, there arises anxiety about the rephosphorization from the desiliconizing- and desulfurizing-slag mixture. However, the present inventors confirmed that no rephosphorization from this slag mixture to the molten pig iron occured at the desiliconization step under a slag condition. This condition is apparent from FIG. 3 and is that the ratio of $CaO/SiO_2$, which determines the phosphorus distribution between the dephosphorizing slag and the molten pig iron, is not less than 1.5 ($CaO/SiO_2 \geqq 1.5$). The following table indicates that the ratio of $CaO/SiO_2$ of the desiliconizing- and desulfurizing-slag mixtures is from 1.5 to 2.8 and thus does not result in rephosphorization.

TABLE 1

| Slags | Components | | | |
|---|---|---|---|---|
| | CaO% | $SiO_2$% | $P_2O_5$% | $CaO/SiO_2$ |
| Dephosphorizing Slag | 50~60 | 8~18 | 4~8 | 3~5 |
| Desiliconizing Slag | 20~30 | 31~42 | 0.1~0.7 | 0.4~1.0 |
| Slag Mixture | 37~47 | 12~22 | 2~4 | 1.5~2.8 |

If the basicity of the desiliconizing- and dephosphorizing-slag mixture is less than 1.5, CaO is added to this slag to adjust the ratio $CaO/SiO_2$.

The embodiments and refining agents described above should be construed to be illustrative but not limiting the present invention, in which: the steelmaking process from the molten pig iron to molten steel stages is divided into four separate steps for reducing the respective impurity to a desired level; and, the impurity removal steps are arranged in the sequence of desiliconization, dephosphorization, decarburization and desulfurization, which sequence of the four separate steps is the characteristic of this invention. From the above descriptions it should be particularly understood that the present invention includes the following embodiments.

At least in one of the first and second steps, at least one member selected from the group consisting of an iron oxide and an oxygen gas, preferably iron oxide, is used as said oxidizer.

An inert gas or an oxygen gas, i.e. one of the oxidizing agents of the first and second steps, may be used to carry the solid agents in the respective steps, and the solid agents are blown together with the inert gas or oxygen gas into the molten pig iron.

The first step is carried out in one or more places, i.e. at the pig runner formed on the cast floor of a blast furnace, in the mixer car and in the iron ladle, followed by the second step carried out in the mixer car and/or iron ladle.

The present invention is explained hereinafter by way of Examples.

EXAMPLE 1

Table 2 gives an example of the composition of molten iron processed by the steelmaking process and showing each separate refining step.

TABLE 2

| Refining Steps | | Chemical Composition (%) | | | | |
|---|---|---|---|---|---|---|
| | | C | Si | Mn | P | S |
| Blast Furnace | Tapped Composition | 4.8 | 0.45 | 0.51 | 0.119 | 0.033 |
| | First Step (After Desiliconization) | 4.7 | 0.14 | 0.35 | 0.115 | 0.033 |
| Mixer Car | Second Step (After Dephosphorization) | 4.4 | 0.06 | 0.28 | 0.030 | 0.028 |
| Converter | Third Step (After Refining) | 0.07 | — | 0.15 | 0.015 | 0.020 |
| Ladle | Fourth Step (After Tapping) | 0.13 | 0.22 | 0.91 | 0.016 | 0.020 |

TABLE 2-continued

| Refining Steps | Chemical Composition (%) | | | | |
|---|---|---|---|---|---|
| | C | Si | Mn | P | S |
| (After Desulfurization) | 0.13 | 0.22 | 0.95 | 0.017 | 0.005 |

The molten pig iron given in Table 2 was subjected to the following steps. Approximately 22 kg of a mill scale per ton of the molten pig iron was thrown into the tapped molten pig iron at a pig runner of the cast floor of a blast furnace, so as to carry out the desiliconization. After cutting off the resultant slag, the molten pig iron contained in the torpedo cars was subjected to the dephosphorization by blowing, with the aid of an argon gas, approximately 37 kg of a mixed flux (the first refining agent) per ton of the pig iron, which flux was composed of a mill scale, CaO and $CaF_2$ added in the weight proportion of 6:4:1. Subsequently, the molten pig iron and 7 kg of CaO and 8 kg of a lightly baked dolomite per ton of the molten pig iron were charged in an LD converter with a 250 ton capacity. The decarburization-blowing was carried out and approximately 24 kg of slag per ton of the molten steel was formed. The molten steel was received in a 250 ton ladle at the tapping after the decarburization blowing, while suppressing to the atmost the inflow of the converter slag into the ladle. 2.4 kg of aluminum per ton of the molten steel was thrown into the molten steel in the ladle to deoxidize the steel. An argon-gas blowing lance was then advanced and inserted into the molten steel in the ladle and 800 liters of an argon gas per minute was blown into the molten steel so as to mix the steel with approximately 2 kg of CaO powder (the second refining agent) per ton of the molten steel.

EXAMPLE 2

The molten pig iron from a blast furnace was desiliconized in torpedo cars and the resultant desiliconizing slag was raked from the torpedo cars. 37 kg/ton pig iron of the flux mixture composed of mill scale, CaO and $CaF_2$ (the first refining agent) was incorporated into, mixed and stirred with the molten pig iron remaining in the torpedo cars, so as to carry out the dephosphorization. A ladle was prepared to receive the so-treated molten pig iron and this molten pig iron was supplied to the steelmaking step using a converter. The dephosphorizing slag remained in the torpedo cars, when the dephosphorized molten pig iron was poured into the ladle, and then, the torpedo cars containing the dephosphorizing slag were reverted to the desiliconization step. These torpedo cars received the desiliconized molten pig iron and the resultant slag which was formed in the desiliconization step on the cast floor due to the incorporation of mill scale. Neither rephosphorization nor resulfurization from the desiliconizing and dephosphorizing slags were observed when the molten pig iron was contained in the torpedo cars. The slag mixture formed in the torpedo cars as a result of mixing the desiliconizing and dephosphorizing slags mounted to 45 kg/ton, pig iron and had the ratio of $CaO/SiO_2=1.8$. This slag mixture was raked from the torpedo cars and the remaining molten pig iron was dephosphorized by a dephosphorizing flux (the first refining agent) composed of a mill scale, CaO and $CaF_2$. This flux at an amount of 37 kg/ton, pig iron was incorporated into and stirred with the molten pig iron by an injection method. A dephosphorizing slag formed at the dephosphorization step amounted to 25 kg per ton of the pig iron. The so dephosphorized pig iron was transferred from the torpedo cars to a ladle and then transported to a converter. The entire amount of dephosphorizing slag remained in the torpedo cars and was reverted to the desiliconization step as described above. The decarburization and the desulfurization were carried out as described in Example 1.

Table 3 shows the composition of molten iron treated as described hereinabove.

TABLE 3

| Refining Steps | | Chemical Composition (%) | | | | |
|---|---|---|---|---|---|---|
| | | C | Si | Mn | P | S |
| Blast Furnace | Tapped Composition | 4.7 | 0.48 | 0.50 | 0.125 | 0.035 |
| Torpedo Cars | First Step (After Desiliconization) | 4.6 | 0.15 | 0.40 | 0.123 | 0.033 |
| Torpedo Cars | Second Step (After Dephosphorization) | 4.4 | 0.05 | 0.35 | 0.032 | 0.025 |
| Converter | Third Step (After Refining) | 0.07 | — | 0.18 | 0.014 | 0.024 |
| Ladle | Fourth Step (After Tapping) | 0.13 | 0.21 | 0.91 | 0.015 | 0.024 |
| | (After Desulfurization) | 0.13 | 0.21 | 0.95 | 0.016 | 0.004 |

EXAMPLE 3

The desiliconization of molten pig iron was carried out under the following conditions.

1. Amount of treated molten pig iron: 250 tons
2. Iron oxide: 23 kg iron ore/ton of pig iron
3. Oxygen gas (carrier gas of the iron oxide): 1.0 $Nm^3$/ton of pig iron
4. The carrier gas flow rate: 8.3 $Nm^3$/min
5. The incorporation rate of iron oxide: 200 kg/minute
6. Temperature of the molten pig iron: 1350° C. at the beginning and 1340° C. at the end
7. Processing time: 30 minutes
8. Desiliconization installation: an iron ladle
9. Slag:
   The resultant slag formed at the desiliconization amounted to 18 kg per ton of the molten pig iron. The slag was raked from the tilted iron ladle.

The dephosphorization was carried out under the following conditions.

1. The first refining agent:
   21 kg of a mill scale, 28 kg of $CaCO_3$ and 3 kg of $CaF_2$ per ton of the pig iron were thrown down onto the molten pig iron, and 3.5 $Nm^3$ of an oxygen gas per ton of the molten pig iron was blown onto this iron. The flow rate of the oxygen gas was 55 $Nm^3$/min. The mill scale, $CaCO_3$ and $CaF_2$ were stirred with the molten pig iron by an impeller.
2. Temperature of the molten pig iron: 1360° C. at the beginning and 1370° C. at the end.
3. Processing time: 20 minutes.
4. Dephosphorization installation: the iron ladle used for the desiliconization but not containing the desiliconizing slag.
5. Slag:

The resultant slag formed at the desiliconization amounted to 28 kg per ton of the molten pig iron and was raked from the iron ladle.

The decarburization and desulfurization were carried out as described in Example 1. Table 4 shows the composition of the molten iron at each step.

TABLE 4

| Refining Steps | | Chemical Composition (%) C | Si | Mn | P | S |
|---|---|---|---|---|---|---|
| Blast Furnace | Tapped Composition | 4.9 | 0.52 | 0.50 | 0.130 | 0.036 |
| Iron Ladle | First Step (After Desiliconization) | 4.7 | 0.15 | 0.40 | 0.120 | 0.035 |
| Iron Ladle | Second Step (After Dephosphorization) | 4.4 | 0.02 | 0.32 | 0.012 | 0.026 |
| Converter | Third Step (After Refining) | 0.08 | 0.01 | 0.18 | 0.011 | 0.026 |
| Ladle | Fourth Step (After Tapping) | 0.14 | 0.15 | 0.95 | 0.012 | 0.026 |
| | (After Desulfurization) | 0.14 | 0.15 | 0.98 | 0.012 | 0.007 |

EXAMPLE 4

The desiliconization of molten pig iron was carried out under the following conditions.

1. Amount of treated molten pig: 250 tons
2. Iron oxide: 35 kg mill scale/ton of pig iron
3. CaO: 3 kg/ton of pig iron
4. The stirring gas ($N_2$ gas) flow:
   flow rate of 5 $Nm^3$/min and supplying amount 0.4 $Nm^3$ per ton of molten pig iron
5. Temperature of the molten pig iron:
   1400° C. at the beginning and 1360° C. at the end
6. Processing time: 20 minutes
7. Desiliconization installation: torpedo cars
8. Slag:
   The resultant slag formed at the desiliconization amounted to 25 kg per ton of the molten pig iron. The slag was raked from the torpedo cars.

The dephosphorization was carried out as described in Example 3. However, since the desiliconization was carried out in the torpedo cars, the iron ladle was used only for the dephosphorization. The decarburization and desulfurization were carried out as described in Example 1.

Table 5 shows the composition of the molten iron at each step.

TABLE 5

| Refining Steps | | Chemical Composition (%) C | Si | Mn | P | S |
|---|---|---|---|---|---|---|
| Blast Furnace | Tapped Composition | 4.8 | 0.51 | 0.50 | 0.125 | 0.038 |
| Torpedo Cars | First Step (After Desiliconization) | 4.7 | 0.16 | 0.40 | 0.123 | 0.037 |
| Iron Ladle | Second Step (After Dephosphorization) | 4.5 | 0.06 | 0.35 | 0.018 | 0.024 |
| Converter | Third Step (After Refining) | 0.05 | 0.01 | 0.11 | 0.010 | 0.023 |
| Ladle | Fourth Step (After Tapping) | 0.06 | 0.10 | 0.60 | 0.011 | 0.023 |
| | (After Desulfurization) | 0.06 | 0.11 | 0.63 | 0.011 | 0.005 |

EXAMPLE 5

The desiliconization, decarburization and desulfurization of a 250 ton molten pig iron were carried out as described in Example 1. The dephosphorization was carried out under the following conditions.

1. The first refining agent:
   14 kg of a mill scale, 13 kg of quick lime and 3.4 kg of $CaF_2$ per ton of the pig iron were carried by the oxygen gas and blown into the molten pig iron together with the oxygen gas which was incorporated at an amount of 0.8 $Nm^3$ per ton of the pig iron. The flow rate of the oxygen gas was 8 $Nm^3$/min. The mill scale, $CaCO_3$ and $CaF_2$ were supplied at a rate of 300 kg/min.
2. Temperature of the molten pig iron:
   1400° C. at the beginning and 1355° C. at the end.
3. Processing time: 30 minutes
4. Dephosphorization installation:
   torpedo cars. The desiliconized molten pig iron with the resultant slag is transferred into the torpedo cars and this slag was raked from the torpedo cars. After the dephosphorization, the resultant slag of an amount of 25 kg per ton of pig iron was not withdrawn from the torpedo cars but transferred to the desiliconization step.

Table 6 shows the composition of the molten iron at each step.

TABLE 6

| Refining Steps | | Chemical Composition (%) C | Si | Mn | P | S |
|---|---|---|---|---|---|---|
| Blast Furnace | Tapped Composition | 4.9 | 0.60 | 0.40 | 0.130 | 0.040 |
| Torpedo Cars | First Step (After Desiliconization) | 4.8 | 0.12 | 0.30 | 0.128 | 0.041 |
| Torpedo Cars | Second Step (After Dephosphorization) | 4.4 | 0.05 | 0.18 | 0.012 | 0.035 |
| Converter | Third Step (After Refining) | 0.04 | 0.01 | 0.11 | 0.006 | 0.033 |
| Ladle | Fourth Step (After Tapping) | 0.05 | 0.30 | 1.05 | 0.006 | 0.032 |
| | (After Desulfurization) | 0.05 | 0.32 | 1.08 | 0.006 | 0.009 |

EXAMPLE 6

The desiliconization, decarburization and desulfurization were carried out as described in Example 1. The dephosphorization was carried out as described in Example 3.

The desiliconizing and dephosphorizing slags were raked from the torpedo cars and the iron ladle, respectively.

Table 7 shows the composition of the molten iron at each step.

TABLE 7

| Refining Steps | | Chemical Conposition (%) | | | | |
|---|---|---|---|---|---|---|
| | | C | Si | Mn | P | S |
| Blast Furnace | Tapped Composition | 4.8 | 0.44 | 0.60 | 0.110 | 0.025 |
| | First Step (After Desiliconization) | 4.6 | 0.19 | 0.50 | 0.105 | 0.025 |
| Iron Ladle | Second Step (After Dephosphorization) | 4.4 | 0.02 | 0.35 | 0.028 | 0.020 |
| Converter | Third Step (After Refining) | 0.10 | 0.01 | 0.28 | 0.023 | 0.020 |
| Ladle | Fourth Step (After Tapping) | 0.15 | 0.10 | 0.40 | 0.022 | 0.022 |
| | (After Desulfurization) | 0.15 | 0.11 | 0.42 | 0.022 | 0.005 |

EXAMPLE 7

The process of Example 3 was repeated. However, only the mill scale of the first refining agent was thrown down onto the molten pig iron, and the quick lime and $CaF_2$ of the first refining agent were blown together with the oxygen gas, i.e. the carrier gas and one component of the first refining agent.

Table 6 shows the composition of the molten iron at each step.

TABLE 8

| Refining Steps | | Chemical Composition (%) | | | | |
|---|---|---|---|---|---|---|
| | | C | Si | Mn | P | S |
| Blast Furnace | Tapped Composition | 4.9 | 0.60 | 0.40 | 0.128 | 0.040 |
| Torpedo Cars | First Step (After Desiliconization) | 4.9 | 0.15 | 0.32 | 0.122 | 0.040 |
| Torpedo Cars | Second Step (After Dephosphorization) | 4.7 | 0.04 | 0.20 | 0.015 | 0.025 |
| Converter | Third Step (After Refining) | 0.12 | 0.01 | 0.11 | 0.013 | 0.026 |
| Ladle | Fourth Step (After Tapping) | 0.15 | 0.10 | 0.60 | 0.013 | 0.027 |
| | (After Desulfurization) | 0.15 | 0.09 | 0.62 | 0.013 | 0.004 |

We claim:

1. A process for making steel by separate steps comprising:

(a) a first step of desiliconizing molten pig iron produced by means of a blast furnace equipped with a cast floor, said desiliconizing being carried out in a pig runner on the cast floor of said blast furnace, by incorporating in said molten pig iron an oxidizer selected from the group consisting of an iron oxide and an oxygen-containing gas, whereby a slag is produced produced by said desiliconization, while maintaining the basicity of said slag at 0.4–2.8 throughout said desiliconization, to reduce the silicon content of the molten pig iron to not more than 0.2% and separating said slag from said molten pig iron;

(b) a second step of dephosphorizing the molten pig iron of step (a), said dephosphorization being carried out by transferring the molten pig iron of step (a) to an iron ladle or mixer car and incorporating in said molten pig iron of step (a) a first refining agent comprising a calcium oxide-containing material and an oxidizer selected from the group consisting of an oxygen-containing gas and iron oxide, whereby a further slag is produced by said dephosphorization, while maintaining the basicity of said further slag at not less than 3 during said dephosphorization, to reduce said phosphorus content of said molten pig iron to not more than about 0.040%, and separating the resultant slag from the molten pig iron, (c) a third step of decarburizing said molten pig iron of step (b), said decarburization being performed by transferring the molten pig iron from step (b) to a vessel which is a converter, and blowing an oxygen-containing gas into said molten pig iron in said converter to decarburize said molten pig iron to a desired level to thereby produce molten steel and (d) a fourth step of desulfurizing said molten steel of step (c), said desulfurization being performed by transferring said molten steel from step (c) to another vessel and incorporating in said molten steel a second refining agent consisting essentially of calcium oxide, thereby causing said desulfurization to occur.

2. A process for making steel by separate steps comprising:

(a) a first step of desiliconizing molten pig iron produced by means of a blast furnace, said desiliconization being carried out in an iron ladle by incorporating in said molten pig iron an oxidizer selected from the group consisting of an iron oxide and an oxygen-containing gas, whereby a slag is produced by said desiliconization, while maintaining the basicity of said slag at 0.4–2.8 throughout said desiliconization, to reduce the silicon content of the molten pig iron to not more than 0.2% and separating said slag from said molten pig iron;

(b) a second step of dephosphorizing the molten pig iron of step (a), said dephosphorization being carried out in an iron ladle or mixer car and incorporating in said molten pig iron of step (a) a first refining agent comprising a calcium oxide-containing material and an oxidizer selected from the group consisting of an oxygen-containing gas and iron oxide, whereby a further slag is produced by said dephosphorization, while maintaining the basicity of said further slag and not less than 3 during said dephosphorization, to reduce said phosphorus content of said molten pig iron to not more than about 0.040%, and separating the resultant slag from the molten pig iron, (c) a third step of decarburizing said molten pig iron of step (b), said decarburization being performed by transferring the molten pig iron from step (b) to a vessel which is a converter, and blowing an oxygen-containing gas into said molten pig iron in said converter to decarburize said molten pig iron to a desired level to thereby produce molten steel and (d) a fourth step of desulfurizing said molten steel of step (c), said desulfurization being performed by transferring said molten steel from step (c) to another vessel and incorporating in said molten steel a second refining agent consisting essentially of calcium oxide, thereby causing said desulfurization to occur.

3. A process for making steel by separate steps comprising:

(a) a first step of desiliconizing molten pig iron produced by means of a blast furnace, said desiliconization being carried out in a mixer car, by incorporating in said molten pig iron an oxidizer selected from the group consisting of an iron oxide an an oxygen-containing gas, whereby a slag is produced by said desiliconization, while maintaining the basicity of said slag at 0.4–2.8 throughout said desilicionization, to reduce the silicon content of the molten pig iron to not more than 0.2% and separating said slag from said molten pig iron;

(b) a second step of dephosphorizing the molten pig iron of step (a), said dephosphorization being carried out in an iron ladle or mixer car and incorporating in said molten pig iron of step (a) a first refining agent comprising a calcium oxide-containing material and an oxidizer selected from the group consisting of an oxygen-containing gas and iron oxide, whereby a further slag is produced by said dephosphorization, while maintaining the basicity of said further slag and not less than 3 during said dephosphorization, to reduce said phosphorus content of said molten pig iron to not more than about 0.040%, and separating the resultant slag from the molten pig iron, (c) a third step of decarburizing said molten pig iron of step (b), said decarburization being performed by transferring the molten pig iron from step (b) to a vessel which is a converter, and blowing an oxygen-containing gas into said molten pig iron in said converter to decarburize said molten pig iron to a desired level to thereby produce molten steel and (d) a fourth step of desulfurizing said molten steel of step (c), said desulfurization being performed by transferring said molten steel from step (c) to another vessel and incorporating in said molten steel a second refining agent consisting essentially of calcium oxide, thereby causing said desulfurization to occur.

4. The steelmaking process according to claim 1, 2 or 3, wherein said iron oxide is blown into the molten pig iron together with an inert gas as a carrier gas of the iron oxide.

5. The steelmaking process according to claim 1, 2 or 3, wherein in step (a), the iron oxide is carried by the oxygen gas and blown together with said oxygen into the molten pig iron.

6. The steelmaking process according to claim 1, 2 or 3, wherein the calcium-oxide-containing material of the step (b) is at least one member selected from the group consisting of CaO and $CaCo_3$.

7. The steelmaking process according to claim 6, wherein at least either one of the CaO or the iron oxide of the first refining agent is carried by the oxygen gas of said oxidizer and is blown together with the oxygen gas into the molten pig iron in said step (b).

8. The steelmaking process according to claim 6, wherein at least either one of the CaO or the iron oxide of the first refining agent is carried by an inert gas and is blown together with an inert gas into the molten pig iron in said step (b).

9. The steelmaking process according to claim 1, 2 or 5, wherein said second refining agent is carried by an inert gas and is blown into the molten steel together with the inert gas.

10. The steelmaking process according to claim 1, 2 or 5, wherein said step (b) is carried out in a mixer car.

11. The steelmaking process according to claim 5, wherein said second step is also carried out in the mixer car.

12. The steelmaking process according to claim 1, 2 or 5, wherein said step (b) is carried out in an iron ladle.

13. The steelmaking process according to claim 2, wherein said second step is also carried out in the iron ladle.

14. The process of claim 1 wherein the oxidizer in step (a) is iron oxide.

15. The process of claims 1 or 14 wherein the oxidizer in said step (b) is iron oxide.

16. The process according to claim 1 wherein the silicon content after step (a) is 0.1% or more.

17. The process according to claim 15 wherein the silicon content after step (a) is 0.1%.

18. The process according to claim 1 wherein step (d) employs calcium oxide with a minor proportion of calcium fluoride.

19. The process according to claim 1 wherein said slag basicity of step (a) is 0.4 to about 1.0 and said slag basicity of step (b) is about 3 to 5.

20. The process of claim 2 wherein the oxidizer in step (a) is iron oxide.

21. The process of claims 2 or 20 wherein the oxidizer in said step (b) is iron oxide.

22. The process according to claim 2 wherein the silicon content after step (a) is 0.1% or more.

23. The process according to claim 21 wherein the silicon content after step (a) is 0.1%.

24. The process according to claim 2 wherein step (d) employs calcium oxide with a minor proportion of calcium fluoride.

25. The process according to claim 2 wherein said slag basicity of step (a) is 0.4 to about 1.0 and said slag basicity of step (b) is about 3 to 5.

26. The process of claim 25 wherein the oxidizer in step (a) is iron oxide.

27. The process of claims 25 or 26 wherein the oxidizer in said step (b) is iron oxide.

28. The process according to claim 25 wherein the silicon content after step (a) is 0.1% or more.

29. The process according to claim 27 wherein the silicon content after step (a) is 0.1%.

30. The process according to claim 25 wherein step (d) employs calcium oxide with a minor proportion of calcium fluoride.

31. The process according to claim 25 wherein said slag basicity of step (a) is 0.4 to about 1.0 and said slag basicity of step (b) is about 3 to 5.

* * * * *